US009108448B1

(12) United States Patent
Bergstedt

(10) Patent No.: US 9,108,448 B1
(45) Date of Patent: Aug. 18, 2015

(54) TEMPERATURE CONTROL CIRCUIT FOR AN INKJET PRINTHEAD

(71) Applicant: FUNAI ELECTRIC CO., LTD., Osaka (JP)

(72) Inventor: Steve Bergstedt, Winchester, KY (US)

(73) Assignee: Funai Electric Co., Ltd. (JP)

( * ) Notice: Subject to any disclaimer, the term of this patent is extended or adjusted under 35 U.S.C. 154(b) by 0 days.

(21) Appl. No.: 14/453,442

(22) Filed: Aug. 6, 2014

(51) Int. Cl.
*B41J 29/38* (2006.01)

(52) U.S. Cl.
CPC ..... *B41J 29/38* (2013.01)

(58) Field of Classification Search
USPC ..... 347/5, 9, 14, 16, 17, 19
See application file for complete search history.

(56) References Cited

U.S. PATENT DOCUMENTS

| | | | | |
|---|---|---|---|---|
| 5,764,246 | A * | 6/1998 | Wataya et al. | 347/14 |
| 7,506,956 | B2 | 3/2009 | Usui | |
| 7,651,191 | B2 | 1/2010 | Suzuki | |
| 7,661,782 | B2 * | 2/2010 | Bergstedt et al. | 347/9 |
| 8,075,101 | B2 | 12/2011 | Aoki et al. | |
| 8,197,021 | B2 | 6/2012 | Aoki et al. | |
| 2004/0239711 | A1 * | 12/2004 | Koehler et al. | 347/19 |
| 2005/0104919 | A1 * | 5/2005 | Takayanagi | 347/17 |
| 2012/0007908 | A1 * | 1/2012 | Masuda | 347/17 |
| 2012/0194591 | A1 | 8/2012 | Hagiwara | |
| 2013/3035471 | * | 12/2013 | Murase et al. | 347/14 |

* cited by examiner

*Primary Examiner* — Kristal Feggins
(74) *Attorney, Agent, or Firm* — Amster, Rothstein, Ebenstein LLP

(57) ABSTRACT

A temperature control circuit for an inkjet printhead including a temperature sensor portion that generates an output current made up of the sum of a current proportional to a sensed temperature on the inkjet printhead and an offset current, and an offset current correction portion that generates a correction current that is subtracted from the output current to at least partially compensate for the offset current, the output current as compensated by the correction current being output as a temperature control circuit output current.

13 Claims, 4 Drawing Sheets

TEMPERATURE CONTROL CIRCUIT FOR AN INKJET PRINTHEAD

FIELD

The present invention relates generally to the temperature control of a print head system, and more particularly, relates to a method for storing a determined value on system using a memory element located on the printhead IC.

BACKGROUND

An inkjet printer will produce the best quality when the environment in the region of the ejection nozzle is consistent from one jetting event to the next. Consistent temperature at the start of a jetting is one of the key environmental factors to control in order to produce the best print quality. Consequently, a robust temperature control method is a desirable element in printhead design.

In order to keep costs low, temperature sensors for an inkjet printhead must occupy a minimum layout space on the inkjet printhead IC. One type of sensor produces an output current that is proportional to the temperature on the printhead IC. One tradeoff in the design of this type of sensor is that the space may be minimized if the offset current is allowed to vary from sensor to sensor while the temperature slope is constrained to a constant value for all sensors. The offset current may be sensed at some reference temperature and the value stored by some form of memory. The sensors temperature may then be calculated by using the sensor's present current, the stored offset current, and the temperature slope to determine the temperature of the printhead IC in the vicinity of the temperature sensor.

SUMMARY OF THE INVENTION

In the temperature sensor described above, the offset current value may be stored remotely in the printer's electronic control apparatus, but this requires that each individual sensor on a printhead IC have a memory location and a unique stored offset value. If all the sensors could be calibrated to have identical offset currents using a memory element on the printhead IC, the complexity of the calculation would be reduced. In addition, the cost of the printer would be lowered.

Accordingly, an object of the present invention is to provide a temperature control of a print head system, and more particularly, to provide a method for storing a determined value on system using a memory element located on the printhead IC.

Another object of the present invention is to provide a method by which a charge may be stored on a memory element providing a mechanism for a temperature control reference.

Another object of the present invention is to provide an on chip reference solution that has minimal sensitivity to temperature variation while minimizing the on-die footprint and dependence on external sources.

According to an exemplary embodiment of the present invention, a temperature control circuit for an inkjet printhead comprises: a temperature sensor portion that generates an output current comprising the sum of a current proportional to a sensed temperature on the inkjet printhead and an offset current; and an offset current correction portion that generates a correction current that is subtracted from the output current to at least partially compensate for the offset current, the output current as compensated by the correction current being output as a temperature control circuit output current.

An inkjet printhead according to an exemplary embodiment of the present invention comprises: one or more temperature control circuits each comprising: a temperature sensor portion that generates an output current comprising the sum of a current proportional to a sensed temperature on the inkjet printhead and an offset current; and an offset current correction portion that generates a correction current that is subtracted from the output current to at least partially compensate for the offset current, the output current as compensated by the correction current being output as a temperature control circuit output current.

In an exemplary embodiment, the offset current correction portion comprises a floating gate transistor.

In an exemplary embodiment, the offset current correction portion comprises a current mirror that reduces the correction current.

In an exemplary embodiment, the temperature control circuit has a program mode in which the floating gate is charged.

In an exemplary embodiment, the temperature control circuit has a read mode in which a charge on the floating gate is read to generate the correction current.

In an exemplary embodiment, the temperature sensor portion comprises a band-gap temperature detection circuit.

Other features and advantages of embodiments of the invention will become readily apparent from the following detailed description, the accompanying drawings and the appended claims.

BRIEF DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION

Figure 1:
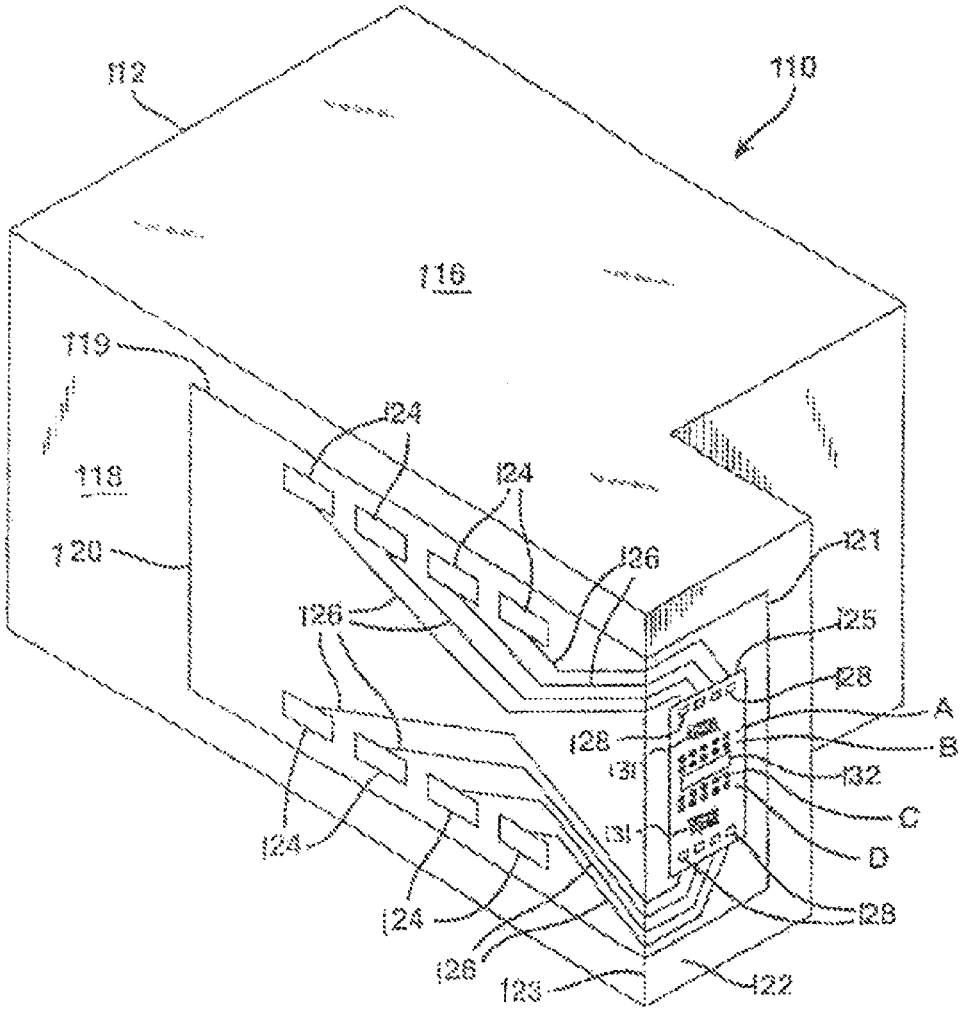
FIG. 1 is a perspective view of a conventional inkjet printhead.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

The principal object of the invention is to provide a method to control temperature on system with a minimal area impact to silicon. The method involves use of an external reference provided through an I/O pad. To this end, a floating gate element can be used to systematically provide a threshold region for a temperature controller reference. The invention provides a way to store incremental levels within the storage element which in turn provides the reference level to the controller.

FIG. 1 shows an inkjet printhead, generally designated by reference number 110. The inkjet printhead 110 includes an actuator chip 125 having one or more temperature sensors 131 that connect to single one of the many I/O terminals expressed representatively as bond pads 128. In form, the output also embodies a current proportional to temperature in a vicinity of the respective temperature sensor 131. Circuitry and other details are described below with reference to other figures.

The printhead 110 has a housing 112 with a shape that depends mostly upon the shape of the external device, e.g., printer, fax machine, scanner, copier, photo-printer, plotter, all-in-one, etc., that contains and uses it. The housing 112 has at least one internal compartment 116 for holding an initial or refutable supply of ink. In one embodiment, the compartment 116 contemplates a single chamber holding a supply of black, cyan, magenta or yellow ink. In other embodiments, the compartment 116 contemplates multiple chambers containing multiple different or same colored inks. The compartment 116 may also exist locally integrated within the housing 112 (as shown) or separable from the housing 112 and/or printhead 110 and connected via tubes or other conduits, for example.

Figure 2:
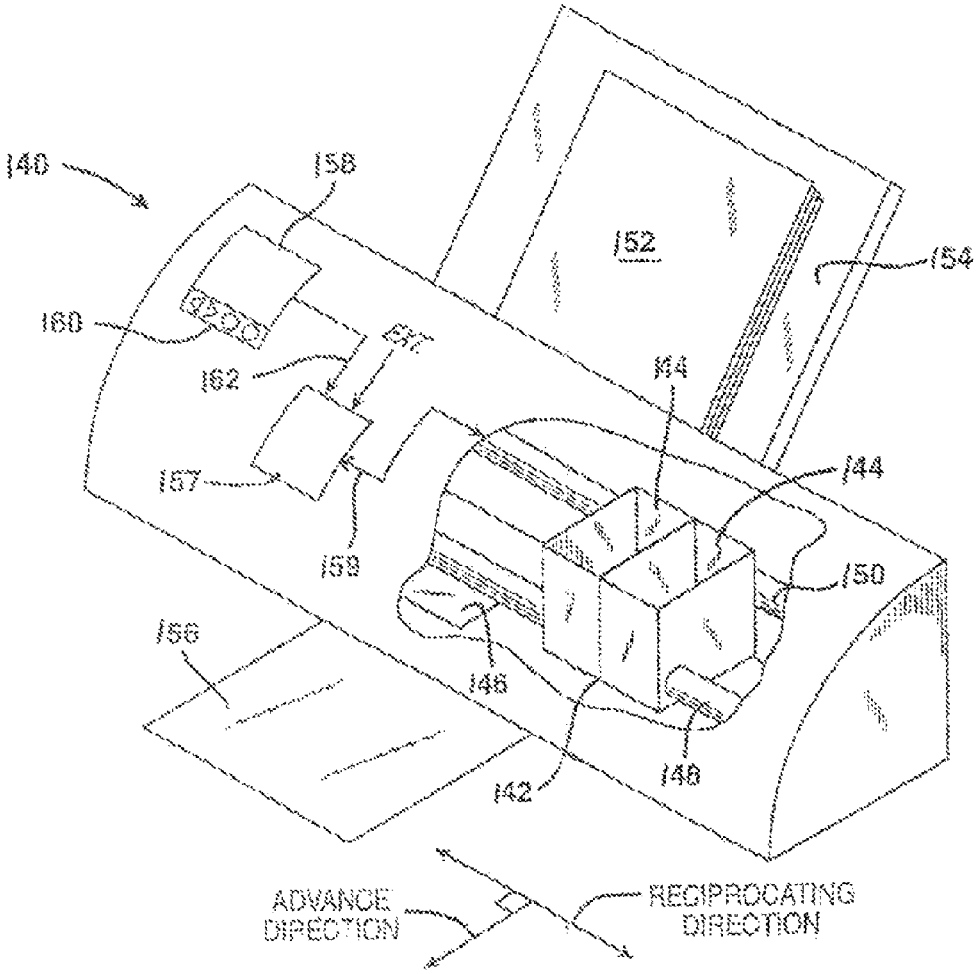
FIG. 2 is a perspective view of a conventional inkjet printer.

At one surface 118 of the housing 112, a portion 119 of a flexible circuit, for example, a tape automated bond (TAB) circuit 120, is adhered. Another portion of the TAB circuit 120 is adhered to surface 122 of the housing 112. Electrically, the TAB circuit 120 supports a plurality of input/output (I/O) connectors 124 for connecting an actuator chip 125, such as a heater chip, to the external device during use. Pluralities of electrical conductors 126 exist on the TAB circuit to connect and short the I/O connectors 124 to the terminals (bond pads 128) of the actuator chip 125, as known by those skilled in the art. Also, FIG. 2 shows eight I/O connectors 124, electrical conductors 126 and bond pads 128, for simplicity, but printheads may have larger quantities and any number is equally embraced herein. The number of connectors, conductors and bond pads, while shown as equal to one another, may also vary unequally in actual embodiments.

The actuator chip 125 contains at least one ink via 132 that fluidly connects to the ink of the compartment 116. During manufacturing, the actuator chip 125 is attached to the housing 112 with any of a variety of adhesives, epoxies, etc. To eject ink, the actuator chip 125 contains columns (column A-column D) of fluid firing actuators, such as thermal heaters. In other chips, the fluid firing actuators embody piezoelectric elements, MEMs devices, transducers or other suitable elements. FIG. 1 simplifies the actuators as four columns of five dots or darkened circles but in practice might number several dozen, hundred or thousand. Individual actuators are formed as a series of thin film layers made via growth, deposition, masking, patterning, photolithography and/or etching or other processing steps on a substrate, such as silicon. A nozzle member with pluralities of nozzle holes (not shown) is adhered to or fabricated as another thin film layer on the actuator chip such that the nozzle holes generally align with and are positioned above the actuators to eject ink.

With reference to FIG. 2, an external device in the form of an inkjet printer, generally designated by reference number 140, contains the printhead 110 during use. The inkjet printer 140 includes a carriage 142 having a plurality of slots 144 for containing one or more printheads 110. The carriage 142 reciprocates (in accordance with an output 159 of a controller 157) along a shaft 148 above a print zone 146 by a motive force supplied to a drive belt 150 as is well known in the art. The reciprocation of the carriage 142 occurs relative to a print medium, such as a sheet of paper 152, which advances in the printer 140 along a paper path from an input tray 154, through the print zone 146, to an output tray 156.

While in the print zone, the carriage 142 reciprocates in a Reciprocating Direction, which is generally perpendicular to an Advance Direction, which is the direction in which the paper 152 is advanced (as shown by the arrows). Ink from compartment 116 (FIG. 1) is caused to eject in a drop(s) from the actuator chip 125 at times pursuant to commands of a printer microprocessor or other controller 157. The timing corresponds to a pattern of pixels of the image being printed. Often times, the patterns are generated in devices electrically connected to the controller 157 (via Ext. input) that reside external to the printer, such as, for example, a computer, a scanner, a camera, a visual display unit or a personal data assistant.

To emit a single drop of ink, an actuator, such as a heater (e.g., one of the dots in columns A-D, FIG. 1), is provided with a small amount of current (such as through a combination, of addressing and pulsing) to rapidly heat a small volume of ink. This causes a portion of the ink to vaporize in a local ink chamber between the heater and the nozzle member, and eject a drop(s) of the ink through a nozzle(s) in the nozzle member toward the print medium. A representative fire pulse used to provide such a current is received at the actuator chip on a terminal (e.g., bond pad 128) (or decoded at the heater chip) from connections allocated between the bond pad 128, the electrical conductors 126, the I/O connectors 124 and the controller 157. Internal actuator chip wiring conveys the fire pulse from the input terminal to one or more of the actuators.

A control panel 158, having user selection interface 160, also accompanies the printer and serves to provide user input 162 to the controller 157 for additional printer capabilities and robustness.

Figure 3:
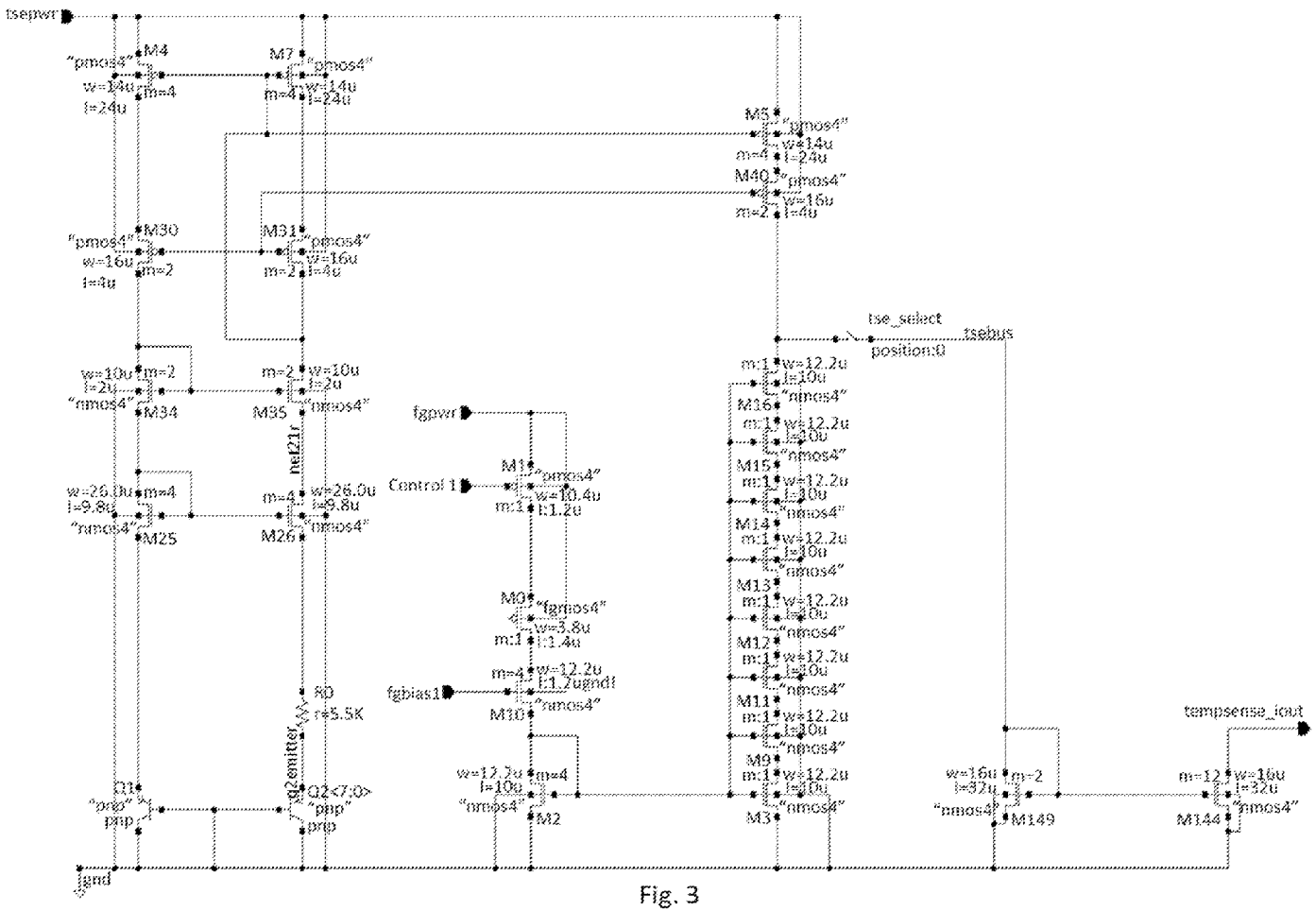
FIG. 3 is a circuit diagram of a temperature control circuit according to an exemplary embodiment of the present invention.

FIG. 3 is a circuit diagram showing a temperature control circuit, generally designated by reference number 1, according to an exemplary embodiment of the present invention. The temperature control circuit 1 is intended to monitor the temperature at a location on the inkjet printhead so that heating elements can be controlled in accordance with the sensed temperature. The heating elements may include substrate heaters whose only function is to heat the chip and/or inkjet heaters that are idle currently in the printing pattern. It should be appreciated that more than one temperature sensor may be included in a printhead IC, in which case each temperature sensor has a corresponding temperature control circuit. The temperature control circuit 1 includes a temperature sensor portion 10 and an offset correction portion 20. The temperature sensor portion 10 may be made up of a conventional band-gap temperature detection circuit including MOSFET transistors M4, M7, M30, M31 M34, M35, M25, M26, M5, M40; bipolar transistors Q1 and Q2; and resistor R0. The output current through M40 is comprised of two components; an offset current plus a current that is proportional to absolute temperature (PTAT) which may be written as:

$$I_{M40}(T)=I_{OFFSET}+B*(T-25^\circ\text{ C.}) \quad (1)$$

where:

T is temperature;

B is the slope of the PTAT temperature current;

$I_{OFFSET}$ is the offset current measured at 25° C.

The design is based on the difference in base-emitter voltages of bipolar transistors Q1 and Q2. Q2 is usually sized larger than Q1 and in this example Q2 is 8 times the area of Q1. This is commonly known in the art as a band gap circuit. The output current is defined by this voltage divided by the value of resistor R0. The material used to make R0 has only a small temperature coefficient. The offset current will vary based on random mismatches mostly in the MOSFET components of each temperature sensor.

The sensor to sensor offset current variation is undesirable in temperature monitoring systems and may be resolved using MOSFET transistors M0, M1, M2, M3 and M9-M16 of the offset correction portion 20. These components are used in each temperature sensor. The core element of the offset correction portion 20 is floating gate MOSFET M0. The floating gate M0 may be permanently charged and used to alter the offset current; the objective being not to remove the offset completely but to make each temperature sensor have the same offset current. MOSFET M1 is used as a switch to connect the floating gate M0 to the voltage at the fgpwr pin. M10 is also used as a switch to provide a voltage potential across the floating gate M0. To add charge to the floating gate M0, the fgpwr voltage is set to a voltage of about 10V, or some other voltage that is high enough to create the charge accumulation on the floating gate M0. The control1 pin is also 10V at this time while the voltage on the fgbias1 pin is set to 3V or some other relatively low voltage so as to avoid accumulation of more charge on the floating gate M0. This is the temperature sensor "program" current mode. Then the control1 voltage is pulsed low (0V) for a period of time, for example 100 microseconds. This results in a quantity of charge to be stored on the floating gate M0. To add more charge to the floating gate M0, the control1 voltage low pulse may be applied repeatedly. When the charge on M0 is sufficient, the voltage on fgpwr is reduced to 3V. The control1 voltage is set to zero volts and the fgbias1 is set to 3V. This is the normal temperature sensor "read" current mode. In practice the circuit is switched from program mode to read mode until the desired current is achieved.

Transistors M2, M3, M9 and M11-M16 form a current mirror that reduces the current through M0 by a factor of 32. This reduces the sensitivity of the temperature sensor output current $I_{M40}$ to large floating gate changes in charge. The current $I_{M16}$ through M16 is subtracted from the temperature sensor current $I_{M40}$ through M40 resulting in a difference current $I_{DIFF}$ that flows through the tse_select switch. In an example system each temperature sensor circuit 1 has a tse_select switch that connects it to an output current mirror 30 (through the tsebus connection) comprised of MOSFET transistors M149 and M144. Only one of all the temperature sensors's tse_select switches is active for a temperature current reading. In this example the output current is then scaled up by a factor of 6 and appears as a PTAT current sink at the tempsense_iout pin.

Figure 4:
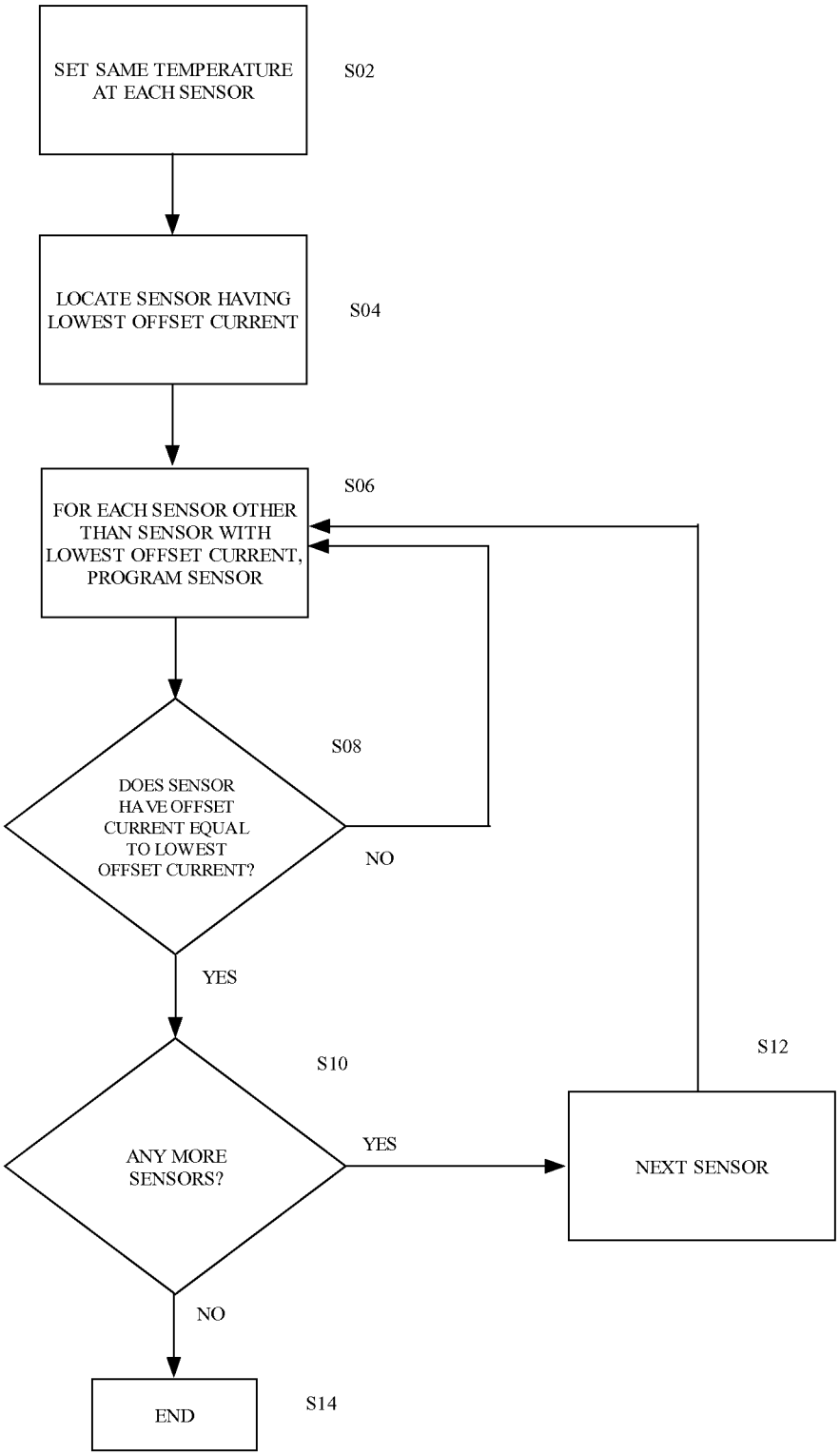
FIG. 4 is a flow chart showing a method of sensing temperature on an inkjet printhead according to an exemplary embodiment of the present invention.

FIG. 4 is a flow chart showing a method for calibrating temperature sensors on an inkjet printhead according to an exemplary embodiment of the present invention. At Step S02 of the method, the system temperature is forced to be the same at all sensors by, for example, placing the wafer on a controlled thermal chuck. The temperature may "read" differently at each sensor due to offset current at each sensor even though the temperature is the same from sensor to sensor. In Step S04, all the temperature sensors in the system are read so as to find the temperature sensor that has the lowest random offset current (without the floating gate programmed; fgbias1 is set to 0 volts). In Steps S06-S12, each temperature sensor's floating gate is programmed and read iteratively until the offset current of each sensor is set equal to the lowest offset current determined in step S04. At the end of the calibration process the temperature sensors in the system will have the same offset current. When the system is in operation, the temperature in the vicinity of each temperature sensor may be determined knowing the offset current and the slope (B) of the PTAT current.

In general, the floating gate M0 can set the drain to source current flowing though it by the amount of charge that is captured on the gate. This charge capture effectively changes the threshold voltage (Vt) of the transistor. In general, the drain current for a transistor can be described by the equation:

$$I = \frac{K}{2}[V_s - \kappa(V_{fg} + V_{th})]^2 \tag{2}$$

After programming, this equation then becomes:

$$I + \Delta I = \frac{K}{2}[V_s - \kappa(V_{fg} + V_{th} + \Delta V_{fg})]^2 \tag{3}$$

Where $$\Delta V_{fg} = \frac{\Delta Q}{C_r}$$

The precision ΔI by which the current can be programmed is thus inversely proportional to gate capacitance and proportional to the amount of charge. To this extent, the device structure of the present invention is designed to use this adjust feature to tune the reference. The typical methods to control the charge placement is by use of the bias voltage level and/or the amount of time the voltage is applied.

During the manufacturing or final assembly of a printhead, an accurate reference/calibration value can then be programmed to the element providing for a self contained closed loop temperature control.

While particular embodiments of the invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A temperature control circuit for an inkjet printhead comprising:

a temperature sensor portion that generates an output current comprising the sum of a current proportional to a sensed temperature on the inkjet printhead and an offset current; and an offset current correction portion that generates a correction current that is subtracted from the output current to at least partially compensate for the offset current, the output current as compensated by the correction current being output as a temperature control circuit output current.

2. The temperature control circuit of claim 1, wherein the offset current correction portion comprises a floating gate transistor.

3. The temperature control circuit of claim 2, wherein the offset current correction portion comprises a current mirror that reduces the correction current.

4. The temperature control circuit of claim 2, wherein the temperature control circuit has a program mode in which the floating gate is charged.

5. The temperature control circuit of claim 2, wherein the temperature control circuit has a read mode in which a charge on the floating gate is read to generate the correction current.

6. The temperature control circuit of claim 1, wherein the temperature sensor portion comprises a band-gap temperature detection circuit.

7. An inkjet printhead comprising:

one or more temperature control circuits each comprising:

a temperature sensor portion that generates an output current comprising the sum of a current proportional to a sensed temperature on the inkjet printhead and an offset current; and an offset current correction portion that generates a correction current that is subtracted from the output current to at least partially compensate for the offset current, the output current as compensated by the correction current being output as a temperature control circuit output current.

8. The inkjet printhead of claim 7, wherein the offset current correction portion comprises a floating gate transistor.

9. The inkjet printhead of claim 8, wherein the offset current correction portion comprises a current mirror that reduces the correction current.

10. The inkjet printhead of claim 8, wherein the temperature control circuit has a program mode in which the floating gate is charged.

11. The inkjet printhead of claim 8, wherein the temperature control circuit has a read mode in which a charge on the floating gate is read to generate the correction current.

12. The inkjet printhead of claim 7, wherein the temperature sensor portion comprises a band-gap temperature detection circuit.

13. The inkjet printhead of claim 7, further comprising one or more heaters, wherein the one or more heaters are controlled based on the temperature control circuit output current.

* * * * *